US010906696B1

(12) United States Patent
El-Alj

(10) Patent No.: US 10,906,696 B1
(45) Date of Patent: Feb. 2, 2021

(54) EDIBLE SUPPLEMENT AND LIQUID CONTAINER ASSEMBLY

(71) Applicant: Mohamed El-Alj, North Miami Beach, FL (US)

(72) Inventor: Mohamed El-Alj, North Miami Beach, FL (US)

( * ) Notice: Subject to any disclaimer, the term of this patent is extended or adjusted under 35 U.S.C. 154(b) by 1 day.

(21) Appl. No.: 16/201,439

(22) Filed: Nov. 27, 2018

Related U.S. Application Data

(60) Provisional application No. 62/608,100, filed on Dec. 20, 2017.

(51) Int. Cl.

| | |
|---|---|
| ***B65D 23/12*** | (2006.01) |
| ***B65D 1/02*** | (2006.01) |
| ***B65D 41/04*** | (2006.01) |
| ***B65D 53/08*** | (2006.01) |

(52) U.S. Cl.
CPC ..... *B65D 23/12* (2013.01); *B65D 1/0246* (2013.01); *B65D 1/0261* (2013.01); *B65D 41/04* (2013.01); *B65D 53/08* (2013.01); *B65D 2501/0081* (2013.01)

(58) Field of Classification Search
CPC ..... B65D 23/12; B65D 1/0246; B65D 1/023; B65D 1/0261; B65D 1/04; B65D 41/04; B65D 53/08; B65D 83/04; B65D 83/0445
USPC ..... 215/6, 383, 378, 370, 44, 10; 206/217, 206/539, 538, 528; 220/23.83; 426/122, 426/106
See application file for complete search history.

(56) References Cited

U.S. PATENT DOCUMENTS

| | | | | |
|---|---|---|---|---|
| D100,412 | S * | 7/1936 | Carp | D9/744 |
| D319,181 | S * | 8/1991 | Balavich | D9/516 |
| 5,050,757 | A * | 9/1991 | Hidding | B65D 21/0237 215/383 |
| 5,351,851 | A * | 10/1994 | Powell | B65D 23/12 215/6 |
| 6,672,817 | B2 * | 1/2004 | Denny | A47G 19/22 426/110 |
| 7,225,937 | B2 * | 6/2007 | Schroeder | B65B 61/202 206/497 |
| 2006/0243699 | A1 * | 11/2006 | Smith | B65D 1/0223 215/384 |
| 2014/0360966 | A1 * | 12/2014 | Howard | B65D 1/04 215/6 |
| 2016/0340083 | A1 * | 11/2016 | Assil | B65D 23/14 |
| 2017/0225821 | A1 * | 8/2017 | Hynes | B65D 1/0261 |

* cited by examiner

*Primary Examiner* — Robert J Hicks
(74) *Attorney, Agent, or Firm* — John Rizvi; John Rizvi, P.A.—The Patent Professor®

(57) ABSTRACT

An edible supplement and liquid container assembly is provided including a container having a container interior. A potable fluid is provided in the container interior. At least one openable supplement compartment is provided on the container. At least one edible supplement is provided in the at least one supplement compartment. A consumer can selectively access the supplement by opening the supplement compartment, removing the supplement from the supplement compartment and ingesting the supplement by drinking the potable fluid. After consuming the supplement, the consumer may drink the remaining portion of the potable fluid.

13 Claims, 14 Drawing Sheets

EDIBLE SUPPLEMENT AND LIQUID CONTAINER ASSEMBLY

CROSS-REFERENCE TO RELATED APPLICATION(S)

This U.S. non-provisional patent application claims the benefit of U.S. provisional patent application No. 62/608,100, filed Dec. 20, 2017, the entire contents of which are incorporated-by-reference herein.

FIELD OF THE INVENTION

The present invention relates generally to vitamin and mineral supplements, and more particularly, to an edible supplement and liquid container assembly which dispenses at least one packaged vitamin, mineral and/or herbal supplement, and further contains a potable fluid to assist with the ingestion of the supplement by a consumer if desired.

BACKGROUND OF THE INVENTION

Vitamin, mineral and herbal supplements are popular among people worldwide.

Supplements include vitamins such as vitamins A, B, C, D and E; minerals such as zinc, magnesium and selenium; and herbs. The active ingredients which are used to formulate supplements may be processed to enhance the potency of the ingredients. The processed supplements are typically packaged in a pill, powder, capsule or liquid form. Supplements are typically taken in a home setting before or after meals. Some supplements may be taken prior to exercise or sports events to enhance the body's response to or utilization of the supplements.

Supplements of each type are typically packaged in bottles or other containers which may be individually purchased. A consumer of the supplements may normally keep the supplement containers at home in a cupboard or drawer. The supplement consumer typically self-administers the supplements at home before or after a meal.

One common drawback of the manner in which supplements are conventionally packaged and administered is that a supplement consumer may inadvertently forget to take the supplements during the course of a typical day. Moreover, the supplement consumer may desire to take the supplement before exercise or a sporting event when the consumer is away from home. In the event that the consumer remembers to take the supplements with him or her when he or she leaves home, a source of water or other beverage with which the consumer can ingest the supplements may not be readily available when the consumer desires to take the supplements.

In recent years, the popularity of bottled water has increased significantly. Water consumers frequently carry bottles of drinking water for health and hydration. The drinking water bottles provide a convenient source of drinking water at any time and place at which the water consumer desires to consume the water throughout the day. Many water consumers may desire to carry bottles of drinking water to the gym or other sporting event in which the consumer may participate. Similarly, bottled beverages such as vitamin or mineral water, sports drinks, soft drinks, and juice are known in the art and consumed alternatively or additionally to water.

Conventional bottles of water in which vitamins or minerals has been dissolved are known in the art. However, the vitamins and minerals may lose potency over time, particularly if exposed to sunlight, rendering the supplements ineffective.

Accordingly, there is an established need for a solution to at least one of the aforementioned problems. For example, there remains a need for a solution which allows the consumption of readily available and full-potency supplements when on the go.

SUMMARY OF THE INVENTION

The present invention is directed to an edible supplement and liquid container assembly which dispenses at least one packaged vitamin, mineral and/or herbal supplement and can contain a potable fluid to assist a consumer in ingesting the supplement. The edible supplement and liquid container assembly may include a container having a container interior. A liquid beverage (i.e. a potable fluid) may be provided in the container interior. At least one openable supplement compartment may be provided on the container. At least one edible supplement may be contained in the supplement compartment. Accordingly, a consumer of the supplement may carry the container throughout the course of the consumer's daily activities. The consumer may selectively access the supplement for consumption by opening the container, opening the supplement compartment, removing the supplement from the supplement compartment and ingesting the supplement by drinking the beverage (i.e., the potable fluid). After consuming the supplement, the consumer may drink the remaining portion of the beverage.

In a first implementation of the invention, an edible supplement and liquid container assembly comprises a container having an interior cavity configured to store a potable fluid. At least one supplement compartment is provided on the container. At least one edible supplement removably is housed within the at least one supplement compartment.

In a second aspect, the edible supplement and liquid container assembly can further include a detachable seal attached to the container to cover the at least one supplement compartment provided thereon. The detachable seal is manually removable to expose the at least one edible supplement housed within the at least one supplement compartment for ingestion.

In another aspect, the edible supplement and liquid container assembly can further include a small container having a top penetrable membrane bonded to a bottom, forming an interior cavity configured to house the at least one edible supplement therein. The small container is configured to fit snugly inside of the at least one compartment provided on the container.

In another aspect, the edible supplement and liquid container assembly can further include a detachable seal attached to the container to cover the at least one supplement compartment and the small container fitted therein.

In another aspect, the small container can be flush with a wall of the container when fitted in the at least one compartment. The edible supplement and liquid container assembly may include a detachable seal affixed to the wall of the container covering the at least one compartment and small container fitted therewithin.

In yet another aspect, the at least one compartment provided on the container can have a shape that is the identical to an exterior profile of the small container.

In another aspect, an exterior profile of the small container can be in the shape of a tear-drop.

In another aspect, the container can include a bottom wall, an upstanding side wall, a shoulder portion, and a neck portion forming the interior cavity. The edible supplement and liquid container assembly can further include a removable top, attachable to the neck portion of the container.

In another aspect, the container can be in the shape of a bottle, and the removable top can be a bottle cap that is threadably attached to the neck finish of the neck of the container.

In yet another aspect, the at least one supplement compartment, the bottom wall, the upstanding side wall, the shoulder portion, and the neck of the container may conjoin to form a unitary body.

In another aspect, the at least one compartment provided can be disposed about an upstanding side wall of the container.

In another aspect, the at least one compartment provided may be disposed about a bottom of the container.

In another aspect, the at least one supplement compartment can include two or more supplement compartments formed in different areas of the container.

In yet another aspect, a supplement compartment of the at least two supplement compartments may be arranged on an upstanding sidewall of the container.

In another aspect, a detachable seal can be attached to the upstanding sidewall of the container to cover the supplement compartment on the upstanding sidewall of the container. The detachable seal may be manually removable to expose the at least one edible supplement housed within the supplement compartment for ingestion.

In another aspect, a supplement compartment of the at least two supplement compartments may be arranged on a bottom wall of the container.

In another aspect, a detachable seal can be attached to the bottom of the container to cover the supplement compartment on the bottom wall of the container. The detachable seal can be manually removable to expose the at least one edible supplement housed within the supplement compartment for ingestion.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

Figure 1:
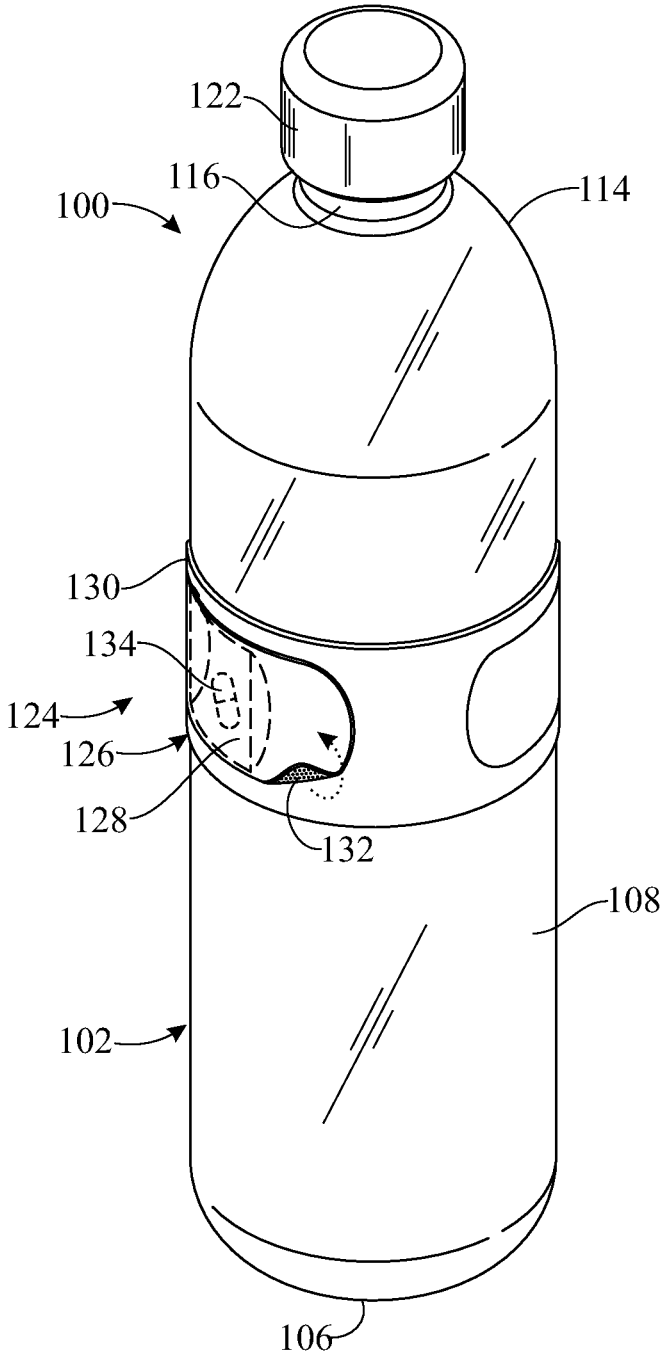
FIG. 1 presents a top front isometric view showing a first illustrative embodiment of the edible supplement and liquid container assembly of the present invention with a side supplement compartment on a container side of the container.
Figure 2:
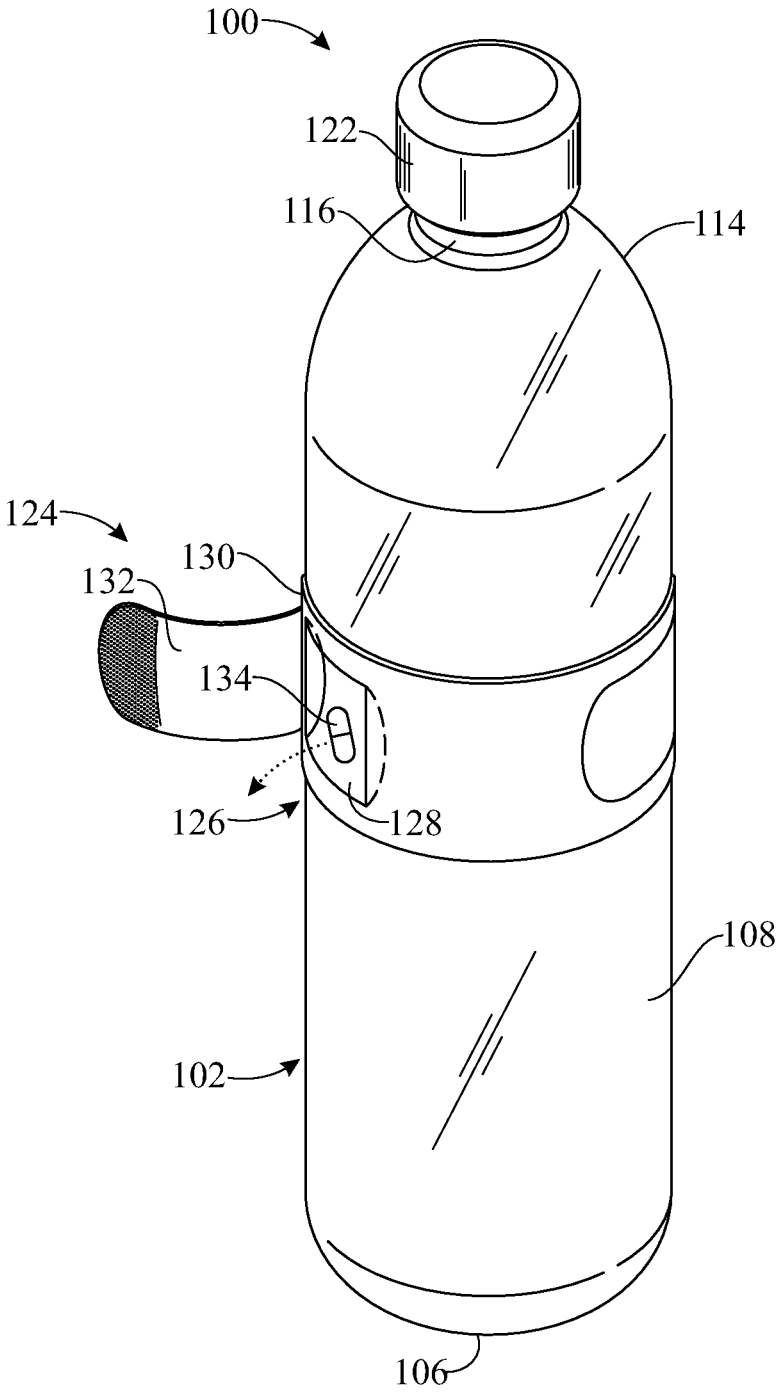
FIG. 2 presents a top front isometric view of the first illustrative embodiment of the edible supplement and liquid container assembly illustrated in FIG. 1, with the detachable seal portion of the compartment seal detached to open the compartment cavity of the side supplement compartment.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward an edible supplement and liquid container assembly which dispenses at least one packaged vitamin, mineral and/or herbal supplement and contains a potable fluid therein to assist a consumer with the ingestion of the supplement.

Figure 3:
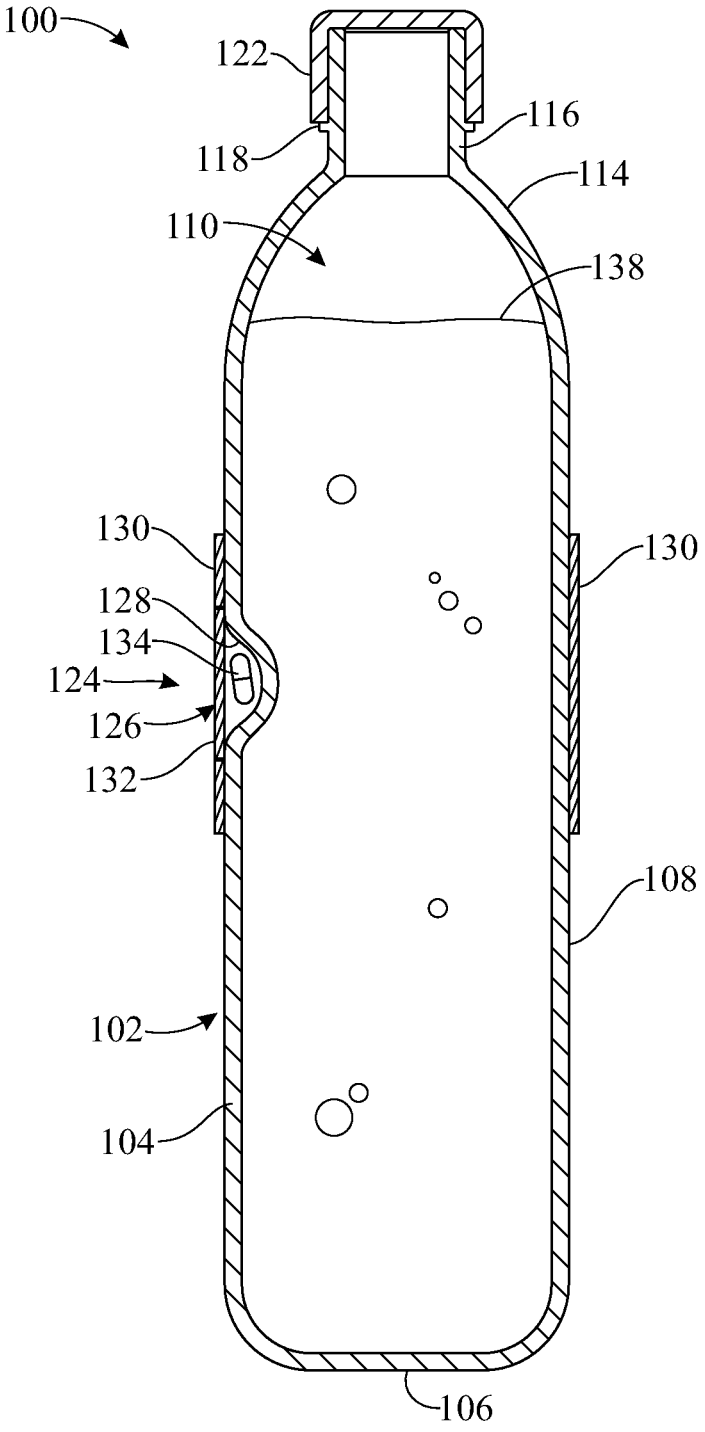
FIG. 3 presents a cross-sectional side elevation view of the edible supplement and liquid container assembly illustrated in FIG. 1, with a liquid beverage contained in the container interior of the container and the detachable seal portion of the compartment seal intact over the compartment cavity of the side supplement compartment.
Figure 4:
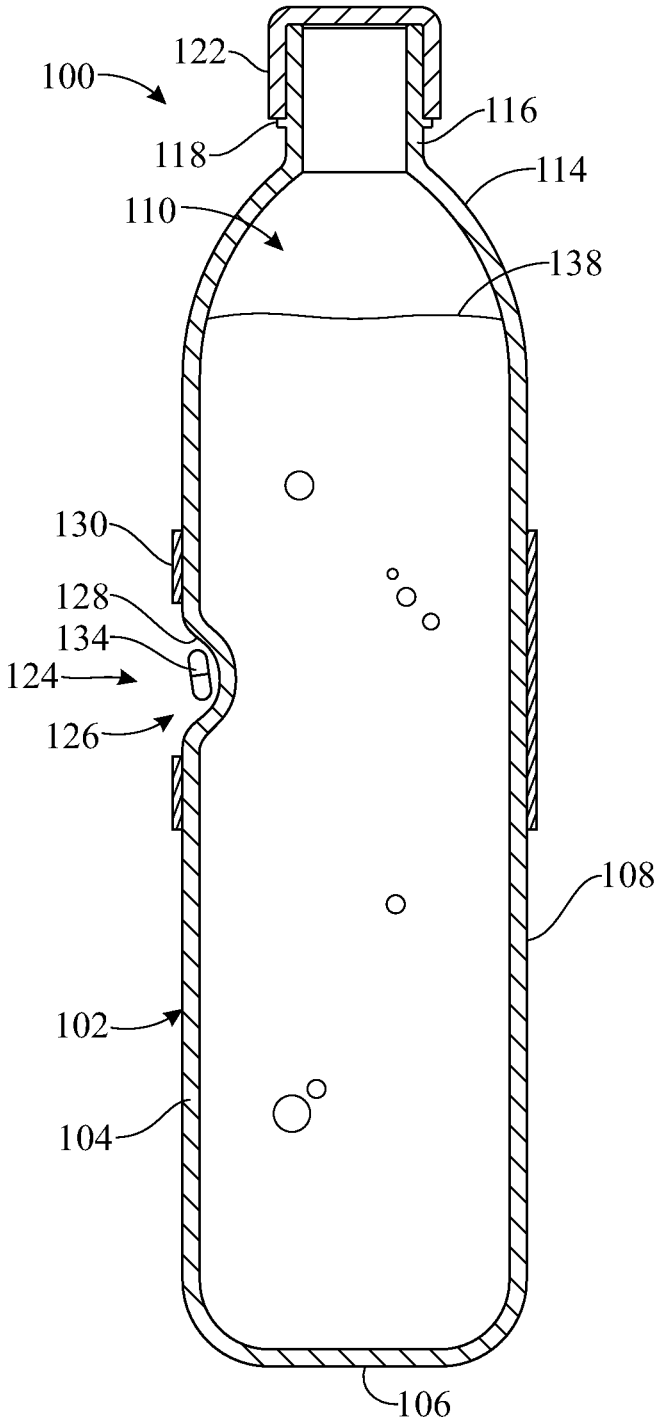
FIG. 4 presents a cross-sectional side elevation view of the edible supplement and liquid container assembly illustrated in FIG. 1, with the detachable seal portion of the compartment seal removed from over the compartment cavity to expose the supplement contained therein.

Referring initially to FIGS. 1-4, an edible supplement and liquid container assembly 100 is illustrated in accordance with an exemplary embodiment of the present invention. As shown, the edible supplement and liquid container assembly 100 may include a container 102. As illustrated in FIGS. 3 and 4, the container 102 may have a container wall 104. A container interior 110 may be formed by the container wall 104. In some embodiments, the container 102 may be configured in the shape of a bottle with a container bottom 106, a container side 108 extending from the container bottom 106, a curved container shoulder 114 extending from the container side 108 and a container neck 116 extending from the container shoulder 114. A removable container cap 122 may be provided on the container neck 116. In some embodiments, the container cap 122 may be threadably attached to the container neck 116. A neck flange 118, shown in FIG. 3, may protrude outwardly from the container neck 116.

As further illustrated in FIGS. 3 and 4, a potable fluid 138 may be contained inside the container interior 110 of the container 102. In some embodiments, the potable fluid 138 may consist of water. In other embodiments, the potable fluid 138 may include vitamin or mineral water, isotonic, hypertonic or hypotonic fluid, a soft drink, fruit juice or other forms of potable fluid. The potable fluid 138 can be accessed for pouring or drinking from the container interior 110 typically by removing, or as illustrated in FIGS. 3 and 4, unscrewing the container cap 122 from the container neck 116 of the container 102.

At least one openable supplement compartment 124 may be provided on the container 102. In some embodiments, the at least one supplement compartment 124 may include at least one side supplement compartment 126. At least one vitamin, mineral and/or herbal supplement 134 may be provided in the side supplement compartment 126. The supplement 134 may be provided in pill, powder, capsule or liquid form. The side supplement compartment 126 may have any design which is suitable for the purpose of containing the supplement 134 in a sealed manner and which is selectively openable by a consumer of the edible supplement and liquid container assembly 100 when consumption of the supplement 134 is desired. In some embodiments, the side supplement compartment 126 may include a compartment cavity 128. The compartment cavity 128 may be formed as a concavity, recess or indentation in the exterior surface of the container side 108. A compartment seal 130 may be affixed to the exterior surface of the container wall 104 via suitable adhesive and/or other conventional attachment mechanisms. The compartment seal 130 may extend over the compartment cavity 128 to normally retain the supplement 134 in the compartment cavity 130. In some embodiments, the compartment seal 130 may be configured as a continuous annular band which extends along and encircles the container side 108 in its entirety, as illustrated, or partially, in alternative embodiments of the invention. The compartment seal 130 may include a detachable seal portion 132 which extends over the compartment cavity 128 and seals the supplement 134 in the compartment cavity 128. The detachable seal portion 132 may be detachably attached to the main portion of the compartment seal 130 through perforations (not illustrated) or other releasable technique which is known by those skilled in the art.

In typical application of the edible supplement and liquid container assembly 100, a consumer (not illustrated) of the supplement 134 may carry the container 102 throughout the course of the consumer's daily activities. The consumer may open the side supplement compartment 126 and expose the compartment cavity 128 typically by peeling the detachable seal portion 132 from the compartment seal 130. The consumer may then remove the supplement 134 from the exposed compartment cavity 128, hold the supplement 134 while they open the dispensing container by removing the container cap 122, and ingest the supplement 134 by drinking the potable fluid 138 contained inside of the container interior 110 through the container neck 116. After ingesting the supplement 134, the consumer may drink the remaining portion of the potable fluid 138 from the container interior 110 or may once again affix the container cap 122 to the container neck 116.

Figure 5:
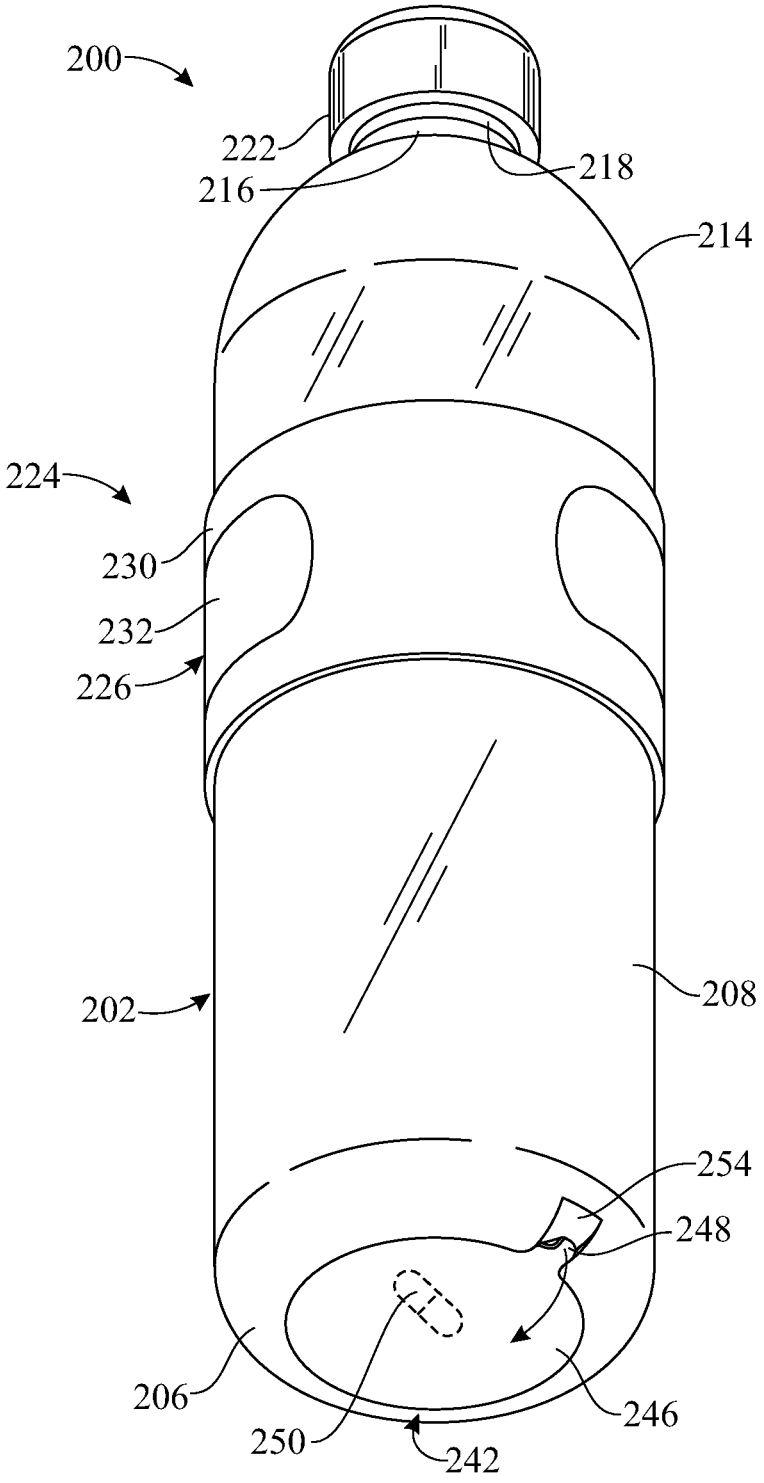
FIG. 5 presents a bottom isometric view of the edible supplement and liquid container assembly according to a second illustrative embodiment of the present invention, with a bottom supplement compartment on a container bottom of the container and a compartment seal of the bottom supplement compartment intact.
Figure 6:
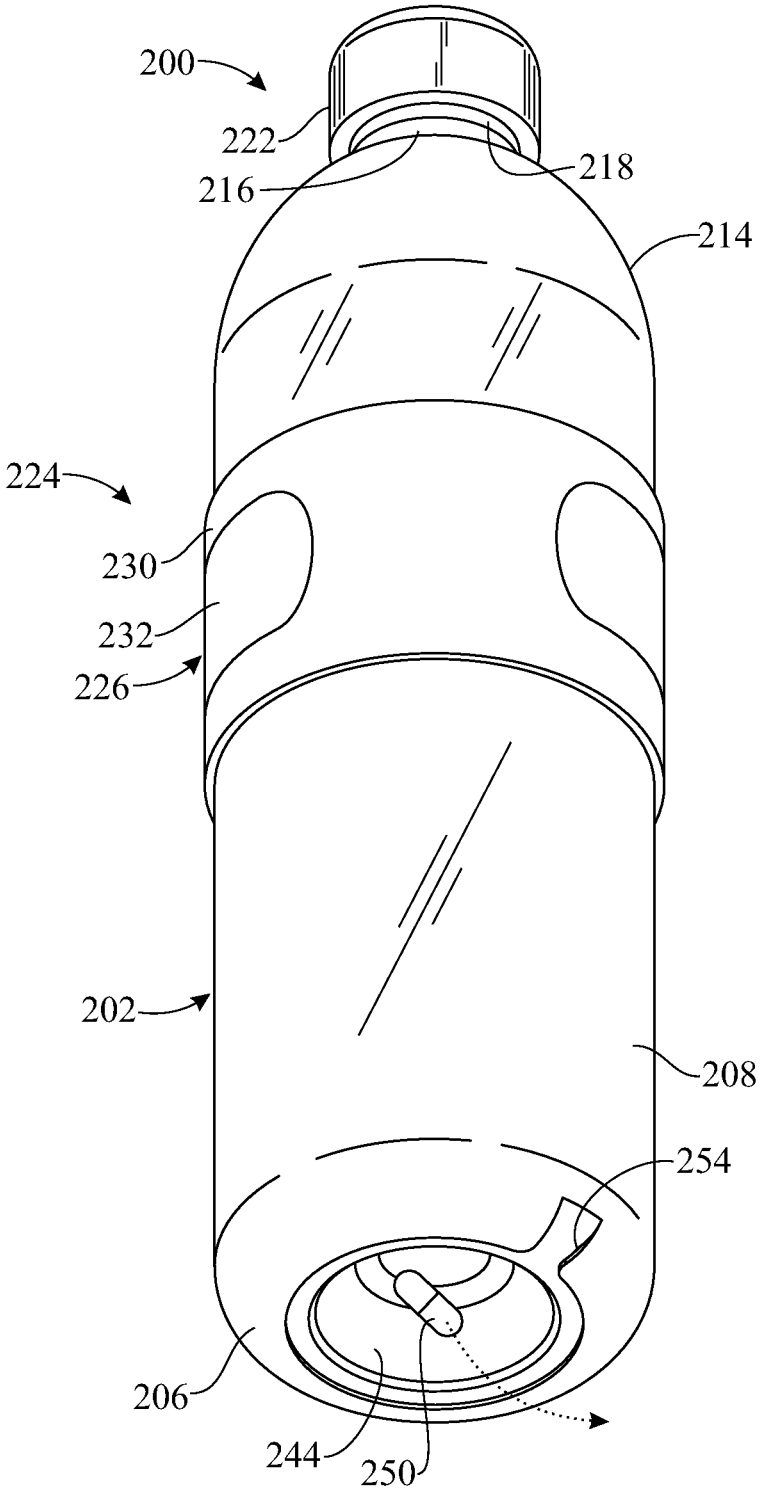
FIG. 6 presents a bottom isometric view of the edible supplement and liquid container assembly illustrated in FIG. 5, with the compartment seal removed from the compartment cavity of the bottom supplement compartment to expose the supplement contained therein.
Figure 7:
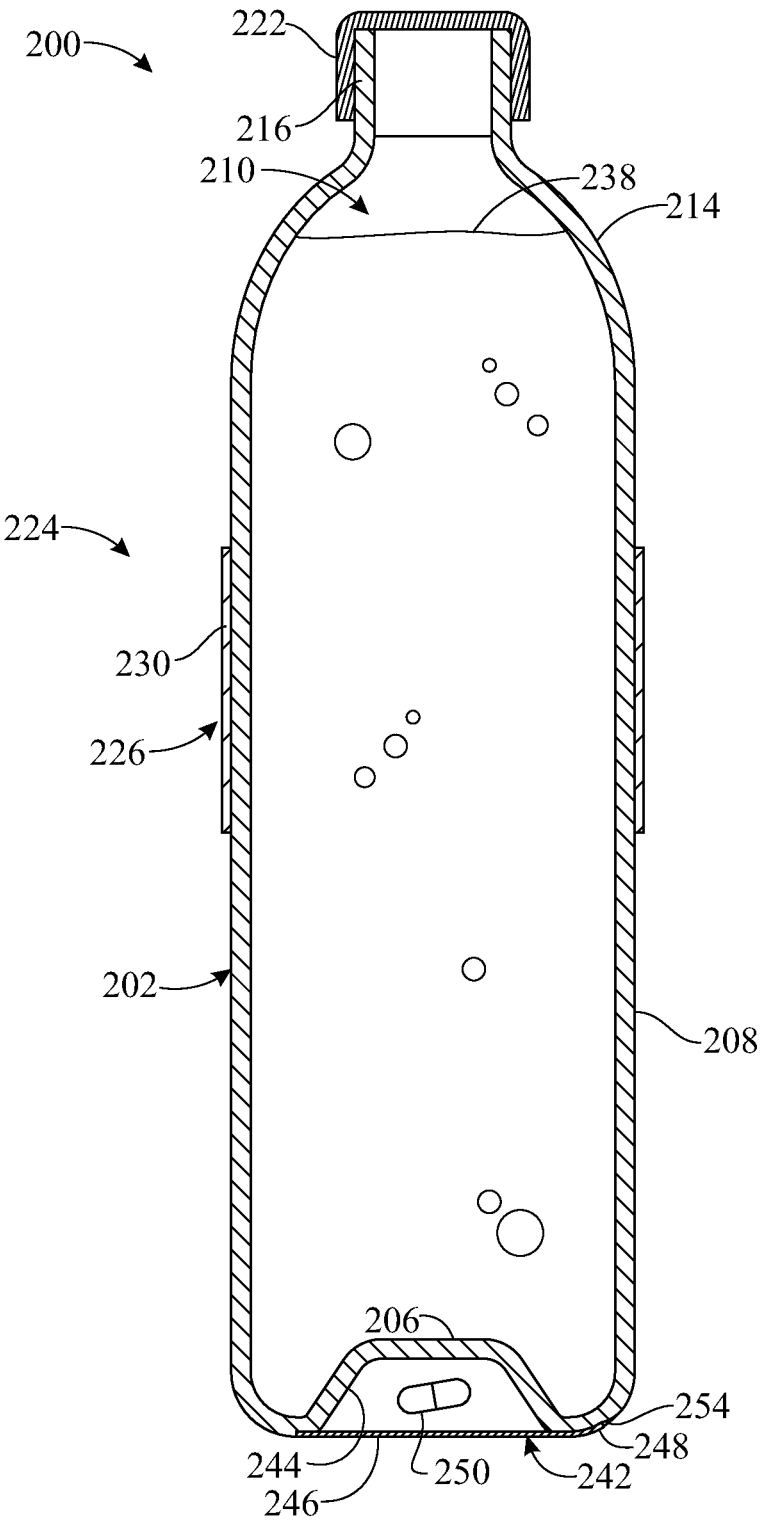
FIG. 7 presents a cross-sectional side elevation view of the edible supplement and liquid container assembly illustrated in FIG. 5, with a liquid beverage contained in the container interior of the container and the compartment seal of the bottom supplement compartment intact over the compartment cavity.
Figure 8:
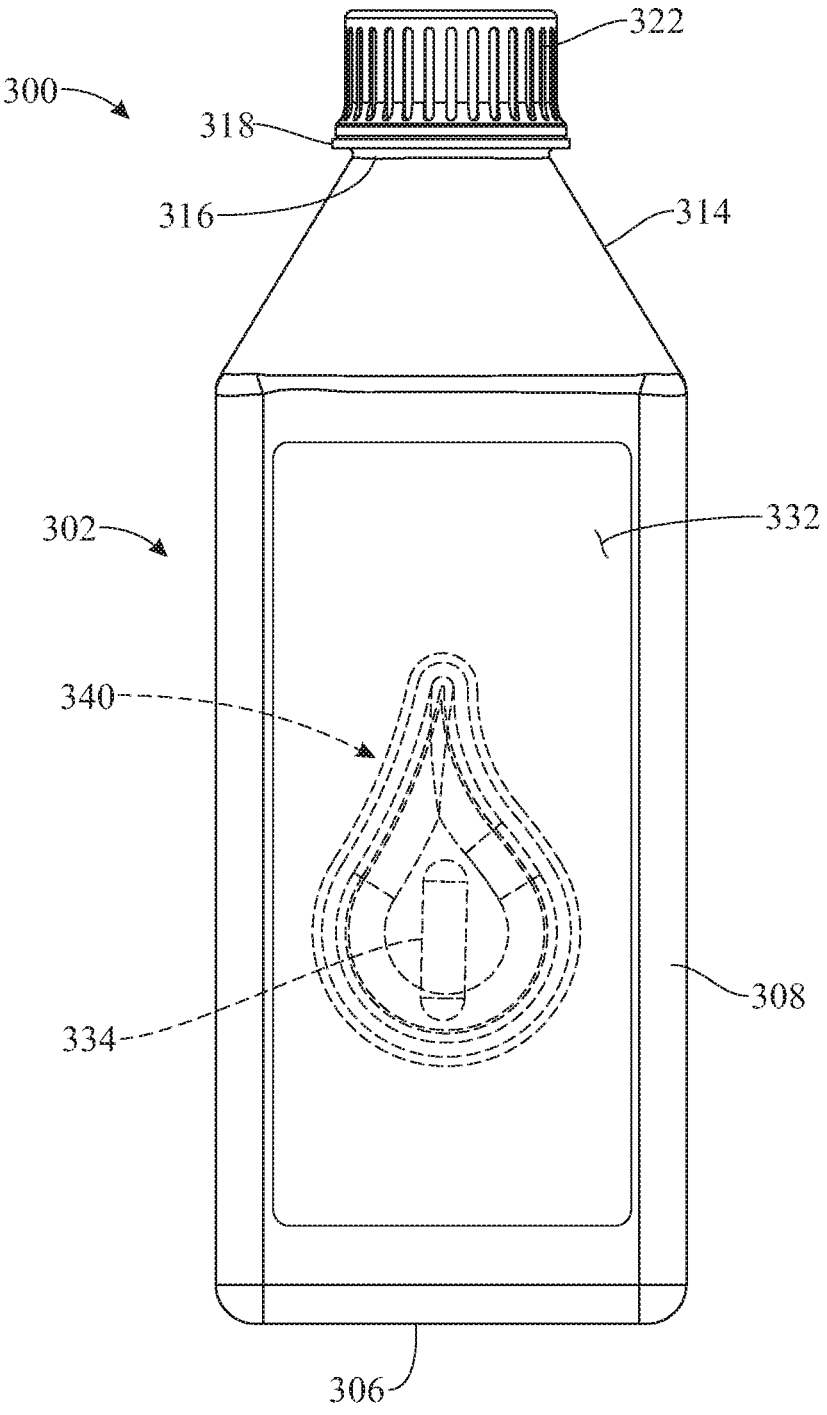
FIG. 8 presents a front elevation view of the edible supplement dispensing contain according to a third embodiment of the present invention, with a supplement compartment on a side of the container.
Figure 9:
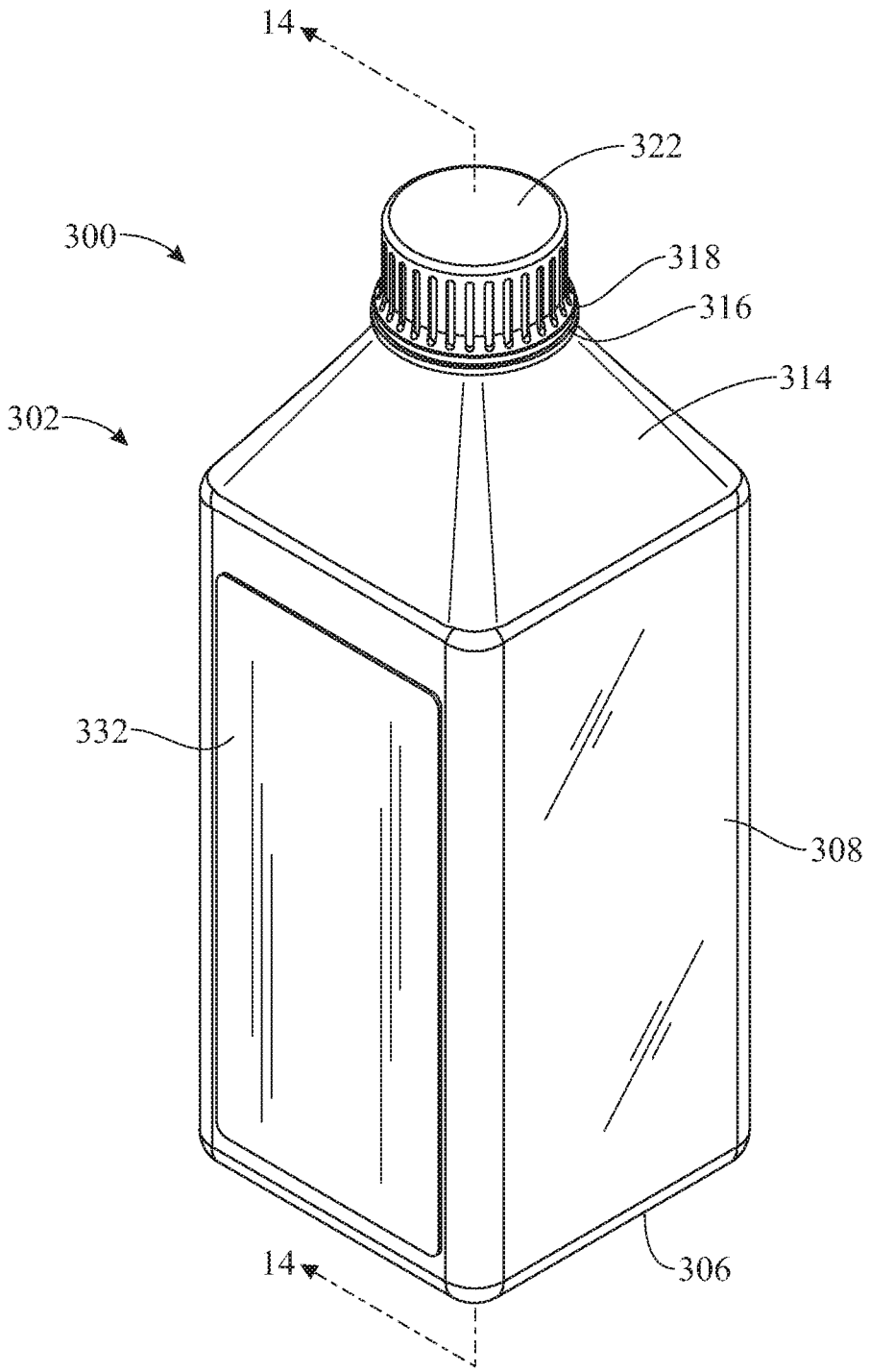
FIG. 9 presents a front perspective view of the edible supplement and liquid container assembly originally presented in FIG. 8, showing a detachable seal affixed to the side of the container.

Referring next to FIGS. 5-7, an alternative illustrative embodiment of the edible supplement and liquid container assembly is generally indicated by reference numeral 200. In the edible supplement and liquid container assembly 200, elements which are analogous to the respective elements of the edible supplement and liquid container assembly 100 that was heretofore described with respect to FIGS. 1-4 are designated by the same respective numerals except preceded by the numeral '2'. At least one supplement compartment 224 may include at least one bottom supplement compartment 242. Optionally, the supplement compartment 224 may further include at least one side supplement compartment 226. The side supplement compartment 226 may have a design which is the same as or similar to that which was heretofore described in FIGS. 1-4 with reference to the side supplement compartment 126.

As illustrated in FIGS. 6 and 7, the bottom supplement compartment 242 may include a compartment cavity 244. The compartment cavity 244 may be formed as a concavity, recess or indentation in the exterior surface of the container bottom 206. As shown in FIGS. 5 and 7, a compartment seal 246 may be affixed to the exterior surface of the container bottom 206 via suitable adhesive and/or other conventional attachment mechanisms. The compartment seal 246 may extend over the compartment cavity 244 to normally retain at least one supplement 250 in the compartment cavity 244. In some embodiments, a seal tab 248 may extend from the compartment seal 246. The seal tab 248 may enable the consumer to grip and pull the compartment seal 246 from the container bottom 206. A tab cavity 254 may be provided in the container bottom 206. The seal tab 248 may normally insert or seat into the tab cavity 254 when the compartment seal 246 is deployed in place over the compartment cavity 244.

Application of the edible supplement and liquid container assembly 200 may be as was heretofore described with respect to the edible supplement and liquid container assembly 100 in FIGS. 1-4. Accordingly, the consumer may access the supplement 250 for retrieval from the compartment cavity 244 by gripping the seal tab 248 and pulling the compartment seal 246 from the container bottom 206. The consumer may drink the potable fluid 238 from the container interior 210 of the container 202 to aid in ingesting the supplement 250, as was heretofore described.

Figure 10:
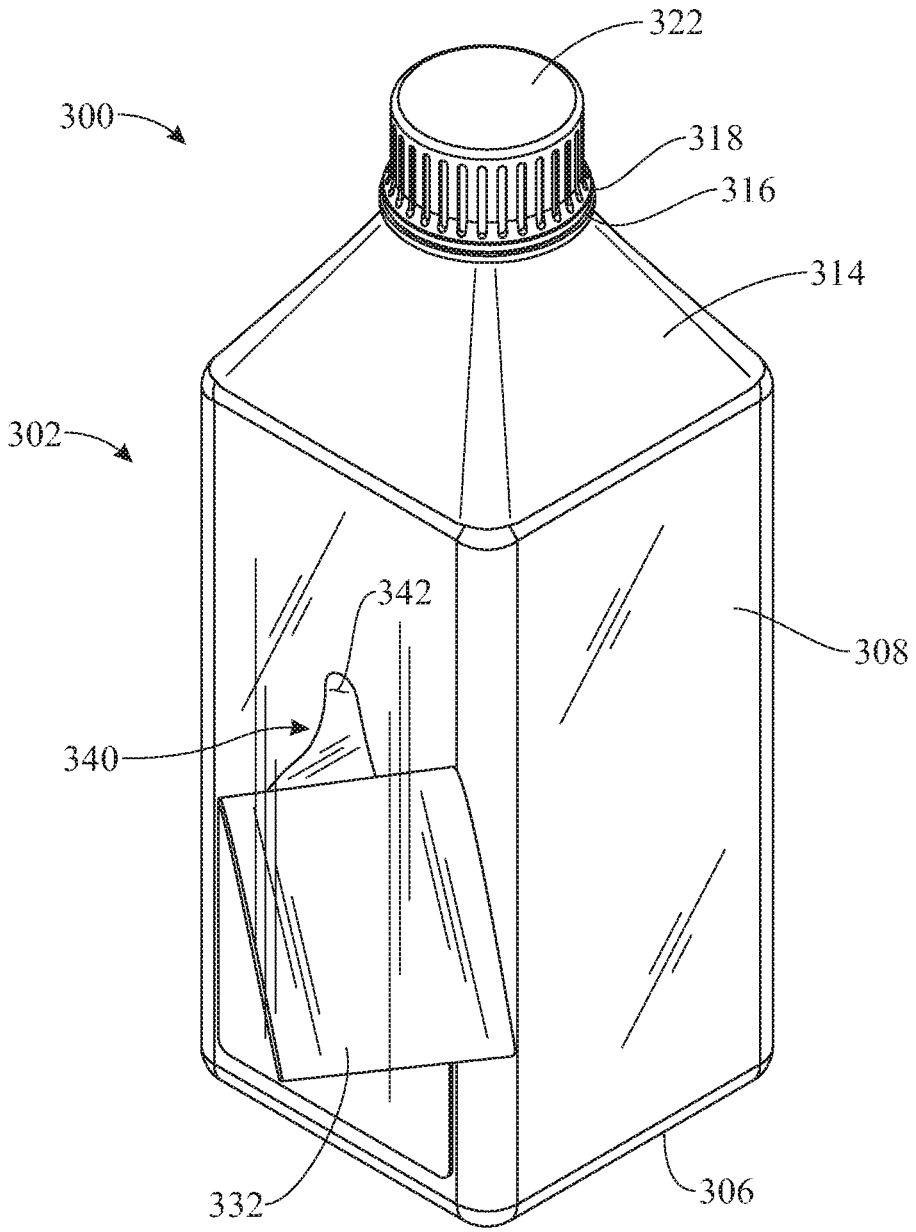
FIG. 10 presents a front perspective view of the edible supplement and liquid container assembly illustrated in FIG. 9, with the detachable seal partially removed from the side of the container.
Figure 11:
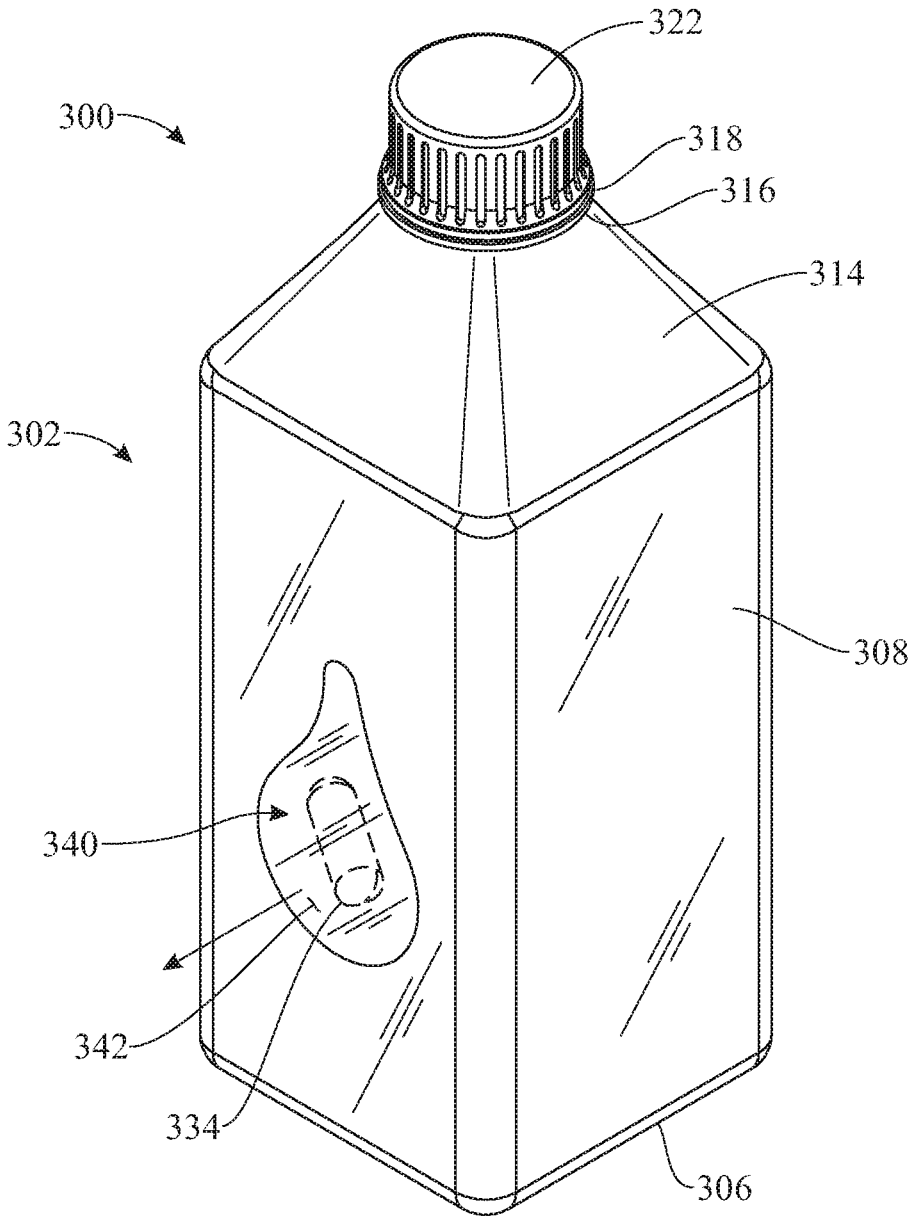
FIG. 11 presents a front perspective view of the edible supplement and liquid container assembly illustrated in FIG. 9, with the detachable seal completely removed from the side of the container exposing an interior compartment housing a removable package with a penetrable membrane.
Figure 12:
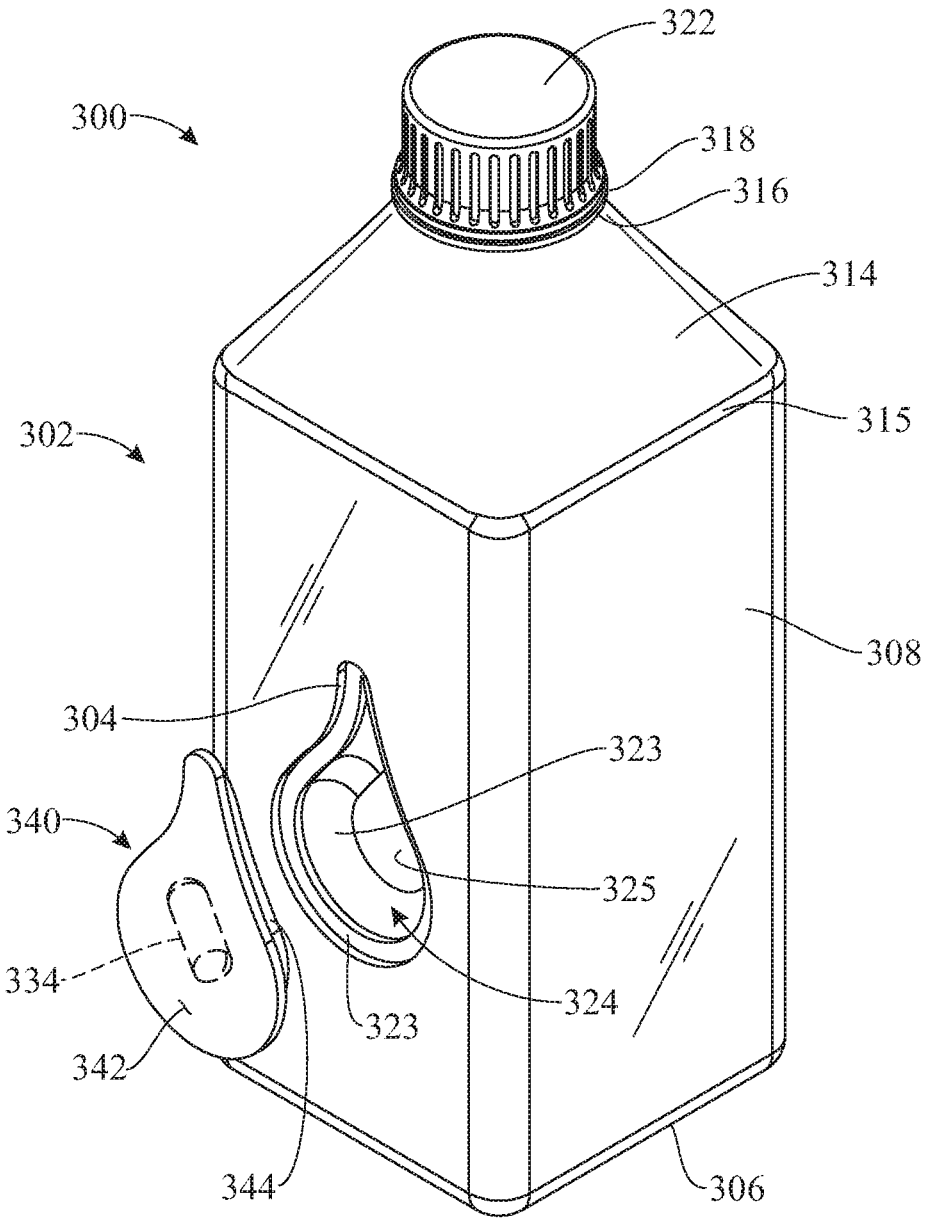
FIG. 12 presents a front perspective view of the edible supplement and liquid container assembly illustrated in FIG. 9, with the removable package completely removed from the container's interior compartment housing.

Attention is now directed to FIGS. 8-14, which shows an alternative embodiment of the edible supplement and liquid container assembly generally referenced as reference numeral 300. Elements of the edible supplement and liquid container assembly 300 which are analogous to the respective elements of the edible supplement container and liquid assemblies 100 and 200 that were heretofore described with respect to FIGS. 1-7, are numbered the same except preceded by numeral '3'. The edible supplement and liquid container assembly 300 may include a container 302 having a container wall 304 formed by a bottom 306, an upstanding side wall 308 extending upwardly from the bottom 306, a curved shoulder 314 that extends from the upstanding side wall 308 and a neck 316 that extends from the container's shoulder 314. Where the upstanding side wall 308 ends and the shoulder portion 314 of the container 300 begins is denoted by an edge 315 (FIG. 12). A removable cap 322 may be provided on the neck 316 of the container 302. The cap 322 may be removably attached to the neck 316 via threads, however, alternative cap mechanisms, such as, flip-tops, pull bottle caps, or sports caps may be used.

Much like what was stated hereinabove, the potable fluid 338 contained within the interior cavity 310 of the container 302 may include different variations of potable fluids, such as, plain water, vitamin water, mineral water, isotonic, hypertonic or hypotonic fluid, fruit juice, carbonated drinks or the like. The potable fluid 338 can be accessed to be ingested by removing the cap 322 from the neck 316 provided at the top of the container 302.

Turning to FIGS. 8-10 and 14, the container 302 may provide at least one interior supplement compartment 324; however, some alternative embodiments—like the one described hereinabove—may include at least two compartments. As can be best seen in FIG. 13, at least one supplement 334, whether it comprises a vitamin, mineral and/or herbal composition, may be included inside of a small container (or package) 340. For example, but not to be limiting, the container 340 used may be in the form of a singular blister pack having a top or outer penetrable membrane 342 and a strong backing 344 forming an interior space used to house the supplement 334. The supplement 334 may be provided in the form of a pill, capsule, powder, or liquid within the container 340.

Figure 14:
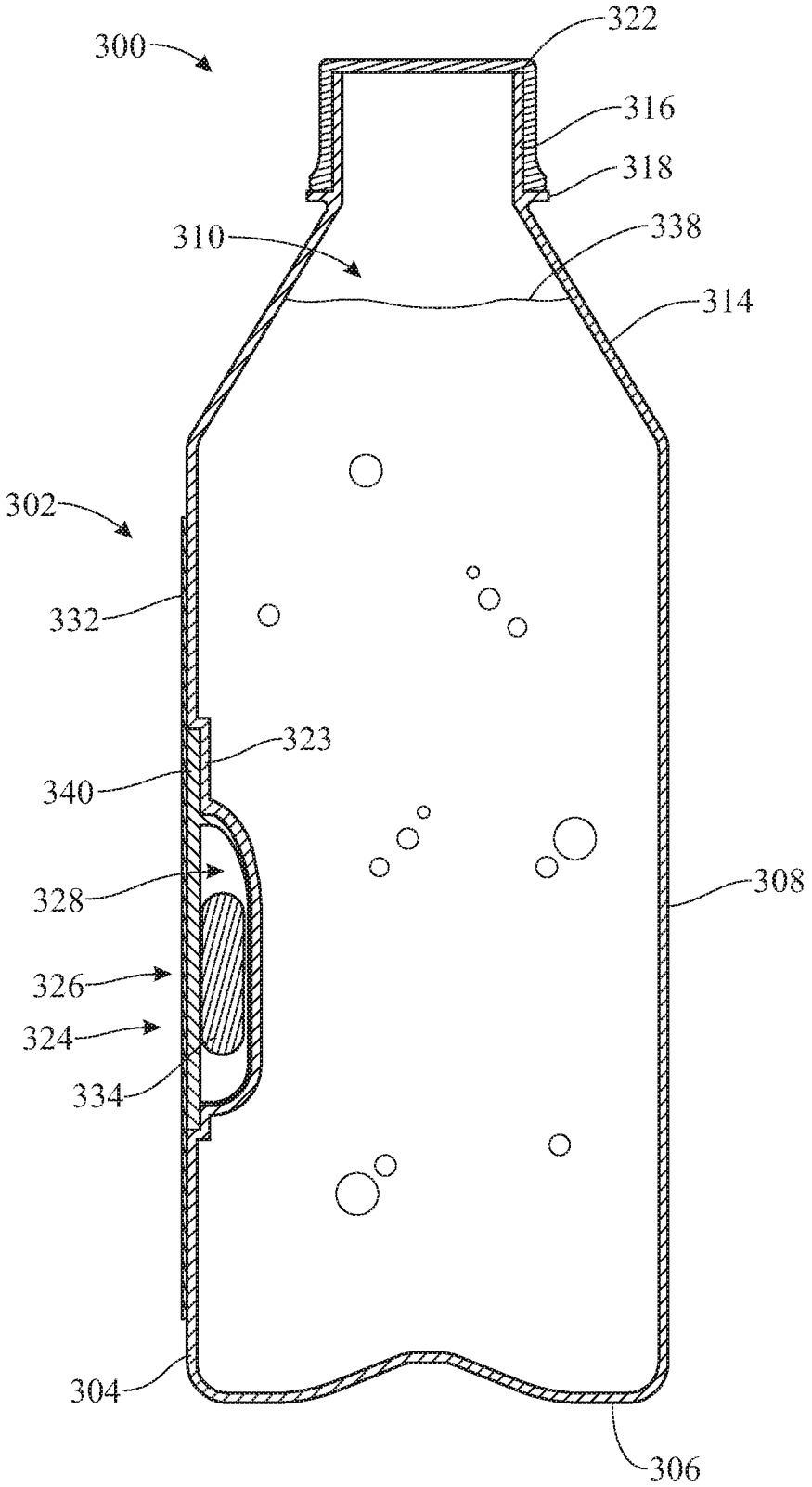
FIG. 14 presents a cross-sectional side elevation view of the edible supplement and liquid container assembly originally illustrated in FIG. 8 and taken across section plane 14-14 in FIG. 9.

As illustrated in FIGS. 12 and 14, the at least one interior supplement compartment 324 that is provided forms an interior cavity 328 within the container 302 and may include a multi-stepped side wall 323 terminating and connecting to a back wall 325. The side wall 323 and back wall 325 of the supplement compartment 324 merge with the container wall 304 of the container 302 to form a unitary body container 302. The interior compartment 324 can be shaped or otherwise configured to receive pre-existing supplement packages. For example, the interior cavity 328 of the interior compartment 324 may be shaped to receive supplement packages that come in circular or rectangular packaging. However, for the sake of illustration purposes only, the present invention shows a uniquely shaped interior compartment 324 in the shape of a tear-drop, which in the case of small children can help parents or physicians convince a small child to ingest the supplement because it would make the supplement look like "fun" to retrieve and consume.

As can be best seen in FIG. 11, when inserting the small container 340 into the interior cavity 328 of the supplement compartment 324 of the container 302, a level plane on the exterior surface of the container 302 is formed; i.e., the outer side of the penetrable membrane 342 is flush with the side wall 308 of the container 302. This facilitates the application of the detachable seal 332 on to the side wall 308 of the container 302, preventing any type of warping of the detachable seal 332 that might have otherwise occurred if the top membrane 342 of the small container 340 did not sit flush with the outer surface of the side wall 308 of the container 302. This further helps with the aesthetic appearance of the container 302, giving it a similar resemblance to that of a normal container. This is especially desirable for consumers that are extremely private and do not wish to disclose to others around them that they are consuming any type of supplement.

Referring to FIGS. 9-13, there can be seen the basic steps of the method of retrieving the supplement 334 from the container's 302 supplement compartment 324. The illustration of FIG. 9 generally shows the edible supplement container 300 with a detachable seal 332 firmly affixed to an upstanding side wall 308 of the container 302. Furthermore, the container's 302 cap 322 is attached and hermetically sealed to the container's neck 316. In this configuration, a consumer can decide to peal the detachable seal 332 from the container's upstanding side wall 308, or break the cap 322 seal and consume the potable liquid that's contained inside the interior cavity 310 of the container 302, thereby saving the supplement for a later time. Alternatively, FIGS. 10 and 11 illustrate how a consumer can peel off the detachable seal 332 off of the container's upstanding side wall 308 to expose the small container (or package) 340 housed within the container's interior compartment 324 to consume the supplement 334 found therein.

Although the seal 332 in the present illustrations is shown being completely removed, it should be readily understood by those skilled in the art that an alternative implementation of the basic principles described hereinabove may be employed. For instance, a seal may be provided that includes at least one half that is detachable and reattachable with the remaining portion permanently affixed to the container's side. This type of concept would allow a consumer to peel back the seal 332 just enough to expose the small container 340 housed within the container's cavity 324 to retrieve at least one supplement 334 and keep any remaining supplements (if any) safely stored inside. Leaving the remaining supplements in the container's supplement compartment for later consumption by firmly reattaching the detached portion of the seal 332 to the container's upstanding side wall 308. Likewise, alternative embodiments are contemplated in which a similar compartment cavity, containing a supplement and enclosed by a removable seal, may be provided in the container cap.

Figure 13:
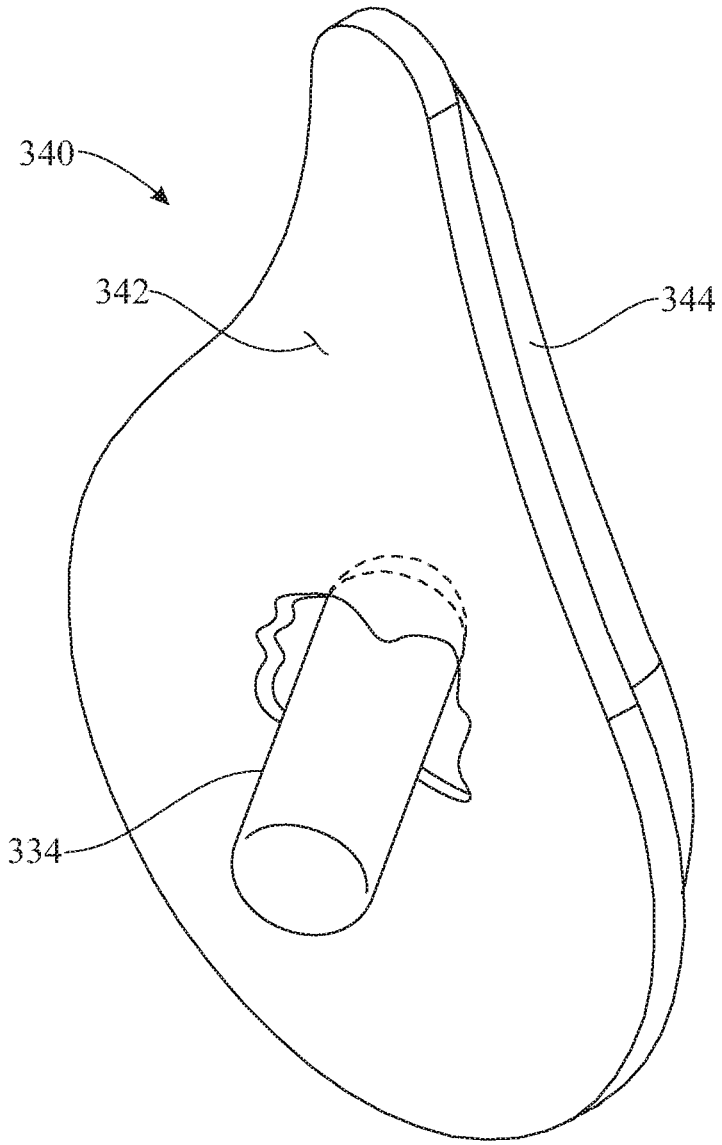
FIG. 13 presents a front perspective view of the removable package originally shown in FIG. 11, with a supplement puncturing through the package's penetrable membrane.

The illustrations of FIGS. 12 and 13 generally show the removal of the small container 340 from the container's 302 interior supplement compartment 324. Once the small container 340 is removed, a consumer may retrieve the supplement 334 that is stored therein by puncturing the small container's top membrane 342. In the case of a capsule or pill, the supplement may be retrieved by pressing on the container's bottom backing 344 with enough pressure that causes the supplement 334 to puncture through the container's membrane 342. In the case of the supplement being a powder or liquid, a small tab (not shown) on the container's top membrane may be included for the consumer to use to remove the membrane to expose the contents that were stored therein. Once the supplement 334 is removed from the small container 340 (or packaging) a consumer may break the hermetically sealed cap—if the consumer has not done so already—and use the potable fluid stored inside of the container to ingest the supplement 334.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. An edible supplement and liquid container assembly, comprising:

a container comprising, a bottom wall, an upstanding side wall, a shoulder portion, and a neck portion forming an interior cavity configured to store a potable fluid;

at least one supplement compartment provided on the container, wherein the supplement compartment is disposed about the upstanding side wall and in material continuation with a surrounding portion of the upstanding side wall of the container, and wherein the supplement compartment is disposed a distance below the shoulder portion of the container;

at least one edible supplement removably housed within the at least one supplement compartment; and a small container having a top penetrable membrane bonded to a bottom, forming an interior cavity configured to house the at least one edible supplement therein, the small container being configured to fit snugly inside of the at least one compartment provided by the container, wherein the top penetrable membrane of the small container is flush with the upstanding side wall of the container providing an uninterrupted side wall surface that is otherwise interrupted absent the small container when fitted in the at least one compartment.

2. The edible supplement and liquid container assembly of claim 1, further comprising a detachable seal attached to the container to cover the at least one supplement compartment and the small container fitted therein.

3. The edible supplement and liquid container assembly of claim 1, wherein the at least one compartment provided on the container has a shape that is the identical to an exterior profile of the small container.

4. The edible supplement and liquid container assembly of claim 1, wherein an exterior profile of the small container is in the shape of a tear-drop.

5. The edible supplement and liquid container assembly of claim 1, wherein the edible supplement and liquid container assembly further comprises a removable top, attachable to the neck portion of the container.

6. The edible supplement and liquid container assembly of claim 5, wherein the container is in the shape of a bottle, and the removable top is a bottle cap that is threadably attached to the neck finish of the neck of the container.

7. The edible supplement and liquid container assembly of claim 1, wherein the at least one supplement compartment, the bottom wall, the upstanding side wall, the shoulder portion, and the neck of the container conjoin to form a unitary body.

8. The edible supplement and liquid container assembly of claim 1, wherein at least a second compartment is disposed about the bottom wall of the container.

9. The edible supplement and liquid container assembly of claim 8, wherein a detachable seal is attached to the upstanding sidewall and bottom wall of the container to cover each one of the supplement compartments respectively, wherein the detachable seal is manually removable to expose the at least one edible supplement housed within the supplement compartment for ingestion.

10. The edible supplement and liquid container assembly of claim 1, wherein the at least one supplement compartment comprises two or more supplement compartments formed in different areas of the container.

11. An edible supplement and liquid container assembly, comprising:

a container comprising, a bottom wall, an upstanding side wall, a shoulder portion, and a neck portion forming an interior cavity configured to store a potable fluid;

at least one supplement compartment provided on the container having a shape, wherein the supplement compartment is in material continuation with a surrounding portion of the upstanding side wall of the container; and wherein the supplement compartment is disposed a distance below the shoulder portion of the container and a distance above the bottom wall of the container;

a small container having a top penetrable membrane bonded to a wall forming an interior cavity, the container matching the shape of the supplement compartment, wherein the small container sits snugly inside of the supplement compartment, and the top penetrable membrane of the small container is flush with the upstanding side wall of the container providing an uninterrupted side wall surface that is otherwise interrupted absent the small container;

at least one edible supplement removably housed within the cavity of the small container; and a detachable seal attached to the container to cover the at least one supplement compartment and the small container snugly seated within the supplement compartment housing the edible supplement.

12. An edible supplement and liquid container assembly, comprising:

a container having a bottom wall, an upstanding side wall, a shoulder portion, and a neck portion forming an interior cavity configured to store a potable fluid;

a removable top, attachable to the neck portion of the container;

at least one supplement compartment provided on the container having a unique shape and a unique periphery, wherein the supplement compartment is in material continuation with a surrounding portion of the upstanding side wall of the container, and wherein the supplement compartment is disposed a distance below the shoulder portion of the container and a distance above the bottom wall of the container;

a small container having a top penetrable membrane bonded to a wall forming an interior cavity, the container having an identical shape and periphery to the supplement compartment, wherein the small container sits snugly inside of the supplement compartment, and the top penetrable membrane of the small container is flush with the upstanding side wall of the container providing an uninterrupted side wall surface that is otherwise interrupted absent the small container;

at least one edible supplement removably housed within the cavity of the small container; and a partially-detachable seal attached to the container to cover the at least one supplement compartment and the small container snugly seated within the supplement compartment housing the edible supplement, wherein only about a first half of the seal is detachable and reattachable to the container and a second half of the seal is not detachable.

13. The edible supplement and liquid container assembly of claim 12, wherein the at least one supplement compartment, the bottom wall, the upstanding side wall, the shoulder portion, and the neck of the container conjoin to form a unitary body.

* * * * *